US009528291B2

(12) United States Patent
Jorba

(10) Patent No.: US 9,528,291 B2
(45) Date of Patent: Dec. 27, 2016

(54) EPHEMERAL ARCHITECTURE DEVICE

(71) Applicant: Jordi Enrich Jorba, Barcelona (ES)

(72) Inventor: Jordi Enrich Jorba, Barcelona (ES)

( * ) Notice: Subject to any disclaimer, the term of this patent is extended or adjusted under 35 U.S.C. 154(b) by 0 days.

(21) Appl. No.: 15/018,051

(22) Filed: Feb. 8, 2016

(65) Prior Publication Data

US 2016/0258181 A1 Sep. 8, 2016

(51) Int. Cl.
*E04H 15/20* (2006.01)
*E04H 15/22* (2006.01)
*E04H 3/22* (2006.01)

(52) U.S. Cl.
CPC ..... *E04H 15/22* (2013.01); *E04H 3/22* (2013.01); *E04H 2015/206* (2013.01)

(58) Field of Classification Search
CPC ..... E04H 15/20; E04H 15/22; E04H 3/10; E04H 3/22; E04H 2015/206
See application file for complete search history.

(56) References Cited

U.S. PATENT DOCUMENTS 3,023,758 A * 3/1962 Diehl ..... E04H 15/22 52/2.23
3,250,024 A * 5/1966 Douthitt ..... G09B 27/02 434/286
3,839,832 A * 10/1974 Kastner ..... E04H 15/22 52/2.14
4,103,369 A * 8/1978 Riordan ..... E04H 15/22 4/499
4,164,829 A * 8/1979 Sadler ..... E04H 1/125 135/117
5,970,661 A * 10/1999 Bishop ..... E04H 15/006 135/125

FOREIGN PATENT DOCUMENTS

GB 1472373 A * 5/1977 ..... E04H 15/22

* cited by examiner

*Primary Examiner* — Robert Canfield
(74) *Attorney, Agent, or Firm* — Young & Thompson

(57) ABSTRACT

Ephemeral architecture device constituted by a dome-shaped receptacle (1) of high strength fabric and a single layer consisting of a multitude of fabric panels (2) artistically sewn together in alternating colors, which in turn comprises sections of independent segments (4) also integrated through sewing. The dome in turn includes: one or more air inflation ports (8) located at the ground level, in which there is coupled in each case one air blowing device such as a fan (9); and a perimeter skirt (6) located along its lower edge and bent inwardly, positioned parallel to the ground on which it is installed, over which a multitude of counterweights (7) are strategically placed along the perimeter.

4 Claims, 2 Drawing Sheets

EPHEMERAL ARCHITECTURE DEVICE

FIELD OF THE INVENTION

The purpose of this invention is an ephemeral architecture device capable of accommodating a large number of users inside it while serving as a projection screen, for the establishment of scenic areas in which events unfold, preferably of a cultural nature being that said device is preferably made from recycled aeronautical equipment.

BACKGROUND OF THE INVENTION

The art or technique of projecting and constructing temporary buildings or spaces is known as ephemeral architecture.

Ephemeral architecture devices are commonly used in events, celebrations and parties of all kinds, as scenery or decoration for a particular event, and are dismantled after they are used.

Therefore, devices intended for this purpose must be easily assembled and dismantled as well as transportable and durable.

There are no known devices equivalent to the ephemeral architecture device that is described or that could be directly comparable to this device, however, the element that is conceptually closest to it is the typical tent, because it can be easily transported as well as assembled and disassembled in a short period of time, not requiring special environmental conditions where it must be located, and allowing one to create a useful space to comfortably accommodate a high volume of attendees.

Traditional tents have a collapsible rigid frame over which a cover is laid that shapes the space. A recent example is described in the utility model with publication number ES1073309, consisting of a tent which is made of a metal structure on which a cover sits whose technological feature is that it is transported on a trailer with a telescopic cylinder capable of holding a central core in which a set of arms are associated, and they constitute the framework on which the canvas is laid.

Other devices are called pressostatic or inflatable tents. This type of tent consists of an inflatable structure that is stiffened by blowing air into the tubular elements that comprise it. An example of such a tent is patent number WO2011045449 which describes a tent formed by inflatable chambers made with plastic layers facing each other and stitched by stitching, which are then supplied with air through turbines.

While this type of tent perfectly fulfills its function of protecting people and everything inside is housed, the assembly is complex and its cost is very high for independent cultural shows and low-budget alternatives.

No ephemeral architecture devices are known that are made from the recycling of aeronautical material.

SUMMARY OF THE INVENTION

The new ephemeral architecture device can be defined as a transportable container dome preferably made from the recycled envelope of a balloon whose interior can accommodate a large number of people, staging furniture etc., while allowing the projection of images on the walls, which are visible both from inside and from outside the tent.

This dome is raised indoors and outdoors when CAVOK weather conditions are given. Its purpose is to provide a scenic setting with a high emotional and artistic effect, completely isolated from the external space, where large gathering events can be held with total safely and with minimal economic impact on the budget of the event. There are no other equivalent devices known.

The present invention involves a dome of high strength synthetic fabric in a single layer, preferably of nylon, Dacron® or Ristop®.

This dome consists of a multitude of fabric panels in alternating colors, artistically sewn together, on which are configured independent segments in sections, also integrated by sewing.

The dome, at ground level, includes a port (or more) on one side, for coupling one or more air blowing devices, such as a fan, and in its lower region, there is a perimeter skirt, operationally bent inward, that is positioned parallel to the ground, with a multitude of counterweights being placed over said skirt, such as sandbags, strategically placed.

The design of the inflation port is basically a circular cut in the fabric of the dome around which are arranged one or more coupling elements with which the blowing device links. Therefore its design and structure will be based on the type and model of the equipment used.

Preferably, the new ephemeral architecture device is made from the recycled envelope of a balloon.

Potentially, for each balloon envelope two devices are made for the invention; one made with the crown of the globe, which is sectioned by the equator, and another made with the section that runs from the throat to the equator line, which is sectioned vertically, reuniting the resulting pieces facing the equator line with a new seam.

Operationally, the new device as described above is fully operational to perform the following actions:

- Extend the dome over the ground where you want the device to be placed.
- Connect the fan or inflation device to the port provided in the dome.
- Fold the skirt into the dome and place the counterweights on it.

The air blown by the fan builds up inside the dome and raises it to the desired setting within minutes. The skirt has the function of preventing the pressure loss at the top, so that once its operating volume is reached, the counterweights impede its rise.

Attendees enter by directly lifting a portion of the skirt, for which the air flow provided by the fans must be available in order to compensate for the dynamic pressure loss that this entails. So, unlike any other known ephemeral architecture device, the proposal for this invention does not require entry or exit doors.

This is very significant, because once the users access the inside and the stretched skirt returns to its working position, they will experience the feeling of being inside a multicolored bubble that sways peacefully if touched, without the visual appearance of any point of entry or exit.

Finally, another peculiarity of the invention that should be noted lies in the ingenious and spectacular way in which it is folded and the group exit of the users from its interior.

With the users distributed in the interior of the dome, the counterweights are removed on one half, and then the fabric is pulled down from the side that retains the counterweights. As a result, the dome is folded upon itself and maintain its curvature rotating about an imaginary axis, on the one side, driven by the weight of the fabric that is being folded, and on the other, driven by the volume of air that escapes through the over-pressure on the open side and the proportional suction of the surrounding outside air, this action being performed in seconds and in total silence. Finally, the dome is folded in an arc on the side which retains the counterweights.

The extreme simplicity of the new ephemeral architecture device, coupled with the ability to manufacture it from the recycled envelope of an expired balloon, means that production costs are lower than those of any other pressostatic tent. In addition to the spectacular nature of the form and use of the device, there is its multipurpose nature, that its surface not only protects and welcomes the users gathered inside, but it also can be used as a video projector screen, with the projections visible from both inside and outside the tent.

BRIEF DESCRIPTION OF THE DRAWINGS

There are two examples of the invention attached, corresponding to the two devices that can be produced from the expired balloon envelope.

REFERENCE LIST

Figure 1:
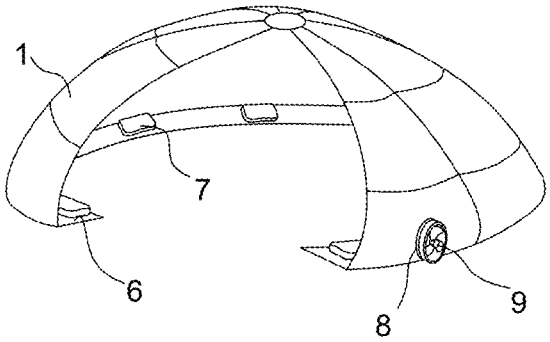
FIG. 1 is a view of the invention made from the crown of a hot air balloon with a partial cut in which its structure can be seen.

1. dome
2. panels
3. sewn panel lines
4. separate sections
5. Sewn section lines
6. Perimeter skirt
7. counterweights
8. port
9. Fan
10. Balloon crown
11. Balloon throat
12. Sewing repositioning the balloon throat

DETAILED DESCRIPTION OF THE INVENTION

Two illustrative uses of the invention corresponding to two devices made from a recycled balloon envelope are attached.

The novel ephemeral architecture device consists of a dome (1) of Dacron® fabric formed by a multitude of panels (2) of different colors, connected by lines of stitching (3) of artistically alternating colors, which in turn consist of separate sections (4) by way of wedges, also integrated by sewing lines (5) perpendicular to the preceding.

This dome (1) includes along its lower edge a peripheral skirt (6) bent inward into the dome, parallel to the ground of the installation, over which the multitude of counterweights (7) are located.

On one side and at ground level, the dome has a port (8) that is basically a circular cut in the fabric, wherein a mechanical air blowing device is engaged, such as a fan (9) as illustrated in the example.

The two illustrated embodiments are made from recycled hot air balloon envelopes.

The illustrated example in FIG. 1 is made from the crown of the balloon (10) that is sectioned along its equator.

Figure 2:
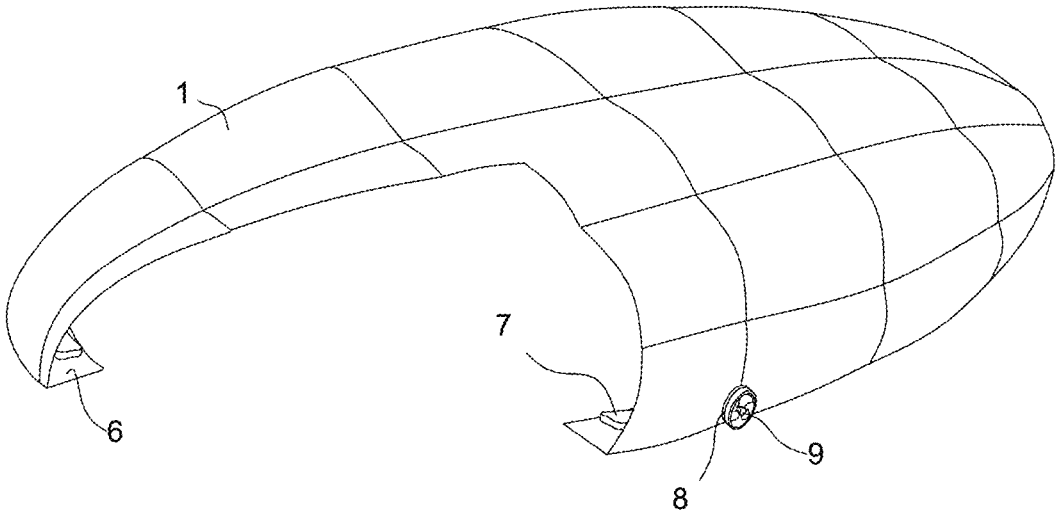
FIG. 2 corresponds to a view of the invention made from the throat of a hot air balloon with a partial cut in which its structure can be seen.
Figure 3:
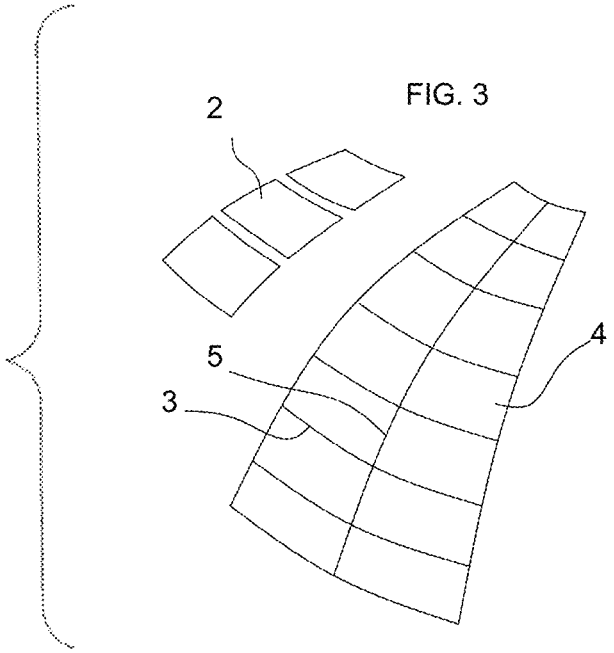
FIG. 3 is a view of the configuration of the elements that constitute the dome.
Figure 4:
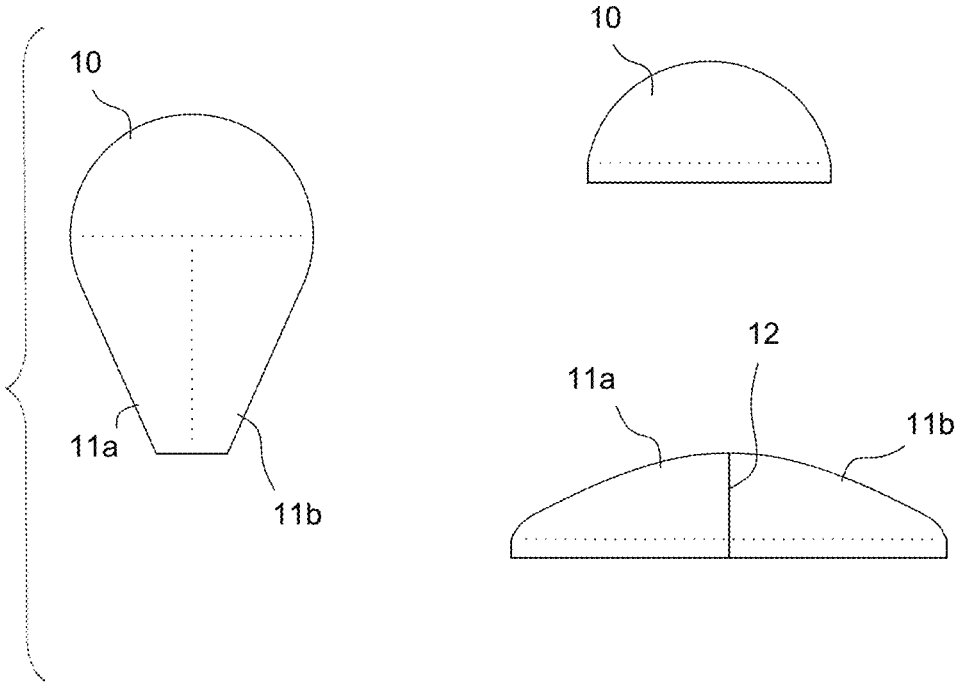
FIG. 4 is a schematic view of the transformation of the envelope of a balloon into a device according to the invention.

The example illustrated in FIG. 2 is made from the section from the throat to the equator line (11) which is sectioned vertically into two parts (11*a*) (11*b*) which are repositioned, reuniting them facing the equator line with a new sewing line (12).

The invention claimed is:

1. An ephemeral architecture device comprising:

a dome-shaped receptacle of fabric and a single layer comprising a plurality of fabric panels sewn together, the plurality of fabric panels comprises sections of independent segments integrated through sewing, the dome-shaped receptacle comprising:

one or more air blowing ports located at the ground level, each of the air blowing ports having one air blowing device coupled thereto; and a perimeter skirt located along a lower edge of the dome-shaped receptacle and bent inwardly, positioned parallel to the ground on which the perimeter skirt is installed, over which a plurality of counterweights are disposed along the perimeter thereof.

2. The ephemeral architecture according to claim 1, wherein the one or more air blowing ports are defined by a circular cut in the fabric of the dome-shaped receptacle around which are disposed one or more coupling elements with which the respective air blowing device is linked.

3. The ephemeral architecture device according to claim 1, wherein the device is made from an expired envelope of a hot air balloon.

4. The ephemeral architecture device according to claim 3, wherein the ephemeral architecture device is formed by one of the crown of the balloon that is cut along the equator line, and a section from the throat to the equator line, which is sectioned vertically and has resulting pieces facing the equator line united with a sewing line.

* * * * *